US006040970A

United States Patent [19]

Lehmann et al.

[11] Patent Number: 6,040,970

[45] Date of Patent: Mar. 21, 2000

[54] INTERRUPTER UNIT OF A HIGH-VOLTAGE POWER CIRCUIT BREAKER

[75] Inventors: Volker Lehmann, Trevenbrietzen; Joachim Gericke, Berlin, both of Germany

[73] Assignee: Siemens AG, Munich, Germany

[21] Appl. No.: 09/171,684

[22] PCT Filed: Apr. 22, 1997

[86] PCT No.: PCT/DE97/00824

§ 371 Date: Feb. 16, 1999

§ 102(e) Date: Feb. 16, 1999

[87] PCT Pub. No.: WO97/40507

PCT Pub. Date: Oct. 30, 1997

[30] Foreign Application Priority Data

Apr. 22, 1996 [DE] Germany ..... 296 07 660 U

[51] Int. Cl.[7] ..... H01H 73/00

[52] U.S. Cl. ..... 361/115; 218/53; 218/54

[58] Field of Search ..... 361/115, 42; 218/43, 218/51, 53, 54, 72

[56] References Cited

U.S. PATENT DOCUMENTS 3,855,436 12/1974 Marin ..... 218/53
5,902,980 5/1999 Reincke et al. ..... 218/155

FOREIGN PATENT DOCUMENTS 2 491 675 4/1982 France .
38 22 410 10/1989 Germany .

*Primary Examiner*—Michael J. Sherry
*Attorney, Agent, or Firm*—Kenyon & Kenyon

[57] ABSTRACT

An interrupter unit of a high-voltage circuit breaker has two arcing contacts, between which an arc is formed in the event of switch-off. A nozzle made of insulating material is provided for blowing out the arc. The nozzle made of insulating material is screwed together with a cylindrical component of the interrupter unit using a thread. In order to secure the thread, a connection piece is provided, which can be inserted in or set on the nozzle made of insulating material, and has a knurling, which can be pressed into the nozzle made of insulating material.

2 Claims, 1 Drawing Sheet

INTERRUPTER UNIT OF A HIGH-VOLTAGE POWER CIRCUIT BREAKER

FIELD OF THE INVENTION

The present invention relates to an interrupter unit of a high-voltage circuit breaker that has at least two arcing contacts and one hollow cylindrical nozzle made of insulating material for blowing out an arc that may form between the arcing contacts and is fastened to a cylindrical component of the interrupter unit.

BACKGROUND OF THE INVENTION

A conventional interrupter unit is described, for example, in French Patent No. 2 491 675 A1. According to the design of the unit described there, a nozzle body made of insulating material is held in a metallic cylindrical component of the interrupter unit.

Under the influence of the hot switching gases, such a nozzle body made of insulating material may become deformed due to the effect of either high temperature or high gas pressure, and it may ultimately become detached from the fastening. The function of the circuit breaker is then no longer guaranteed, since without a properly operating nozzle the arc can no longer be blown out or reliably extinguished.

SUMMARY OF THE INVENTION

An object of the present invention is therefore to design an interrupter unit in which the nozzle made of insulating material is reliably fastened using the simplest possible means.

This object is achieved according to the present invention by the fact that the nozzle made of insulating material has an internal or external thread engaging with the cylindrical component, and a connection piece that can be fastened to the interrupter unit is provided, which supports the nozzle on its lateral surface opposite the thread and is provided with knurling on its side facing the nozzle made of insulating material to secure it against twisting.

Therefore, the connection piece according to the present invention has two functions. It supports the nozzle made of insulating material on the side opposite the thread, so that the nozzle made of insulating material cannot be removed from the thread even by high mechanical and thermal loads. The connection piece, through its knurling on its side facing the nozzle made of insulating material, also prevents the nozzle made of insulating material from twisting, thus preventing the nozzle from being unscrewed from the thread.

The design may feature an internal thread of the nozzle made of insulating material, screwed onto a component of the interrupter unit with the connection piece set onto the nozzle made of insulating material on the outside. The connection piece then has a knurling on its inside. An alternative embodiment of the present invention provides for the nozzle made of insulating material to have an external thread on its outer lateral surface, which is screwed into a cylindrical component of the interrupter unit and the connection piece to be inserted in the nozzle made of insulating material. The connection piece then has a knurling on its external lateral surface.

In both cases, the dimensions of the connection piece and the nozzle made of insulating material are matched to one another so that the knurling is pressed into the material of the nozzle when the connection piece is set onto or inserted into it.

The connection piece is then bonded to the interrupter unit and cannot be twisted.

In a further advantageous embodiment of the present invention the connection piece is connected to a flange, which is non-rotatably connected to the cylindrical component of the interrupter unit.

This flange can be connected to the cylindrical component of the interrupter unit via screws distributed on its periphery, for example.

The cylindrical component of the interrupter unit can, for example, be formed by the bottom of a compressed gas or hot gas chamber.

DETAILED DESCRIPTION

Figure 2:
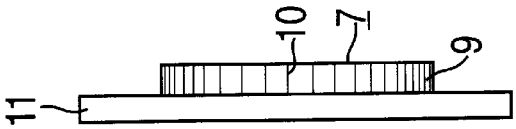
FIG. 2 shows a lateral view of a connection piece with a flange.
Figure 1:
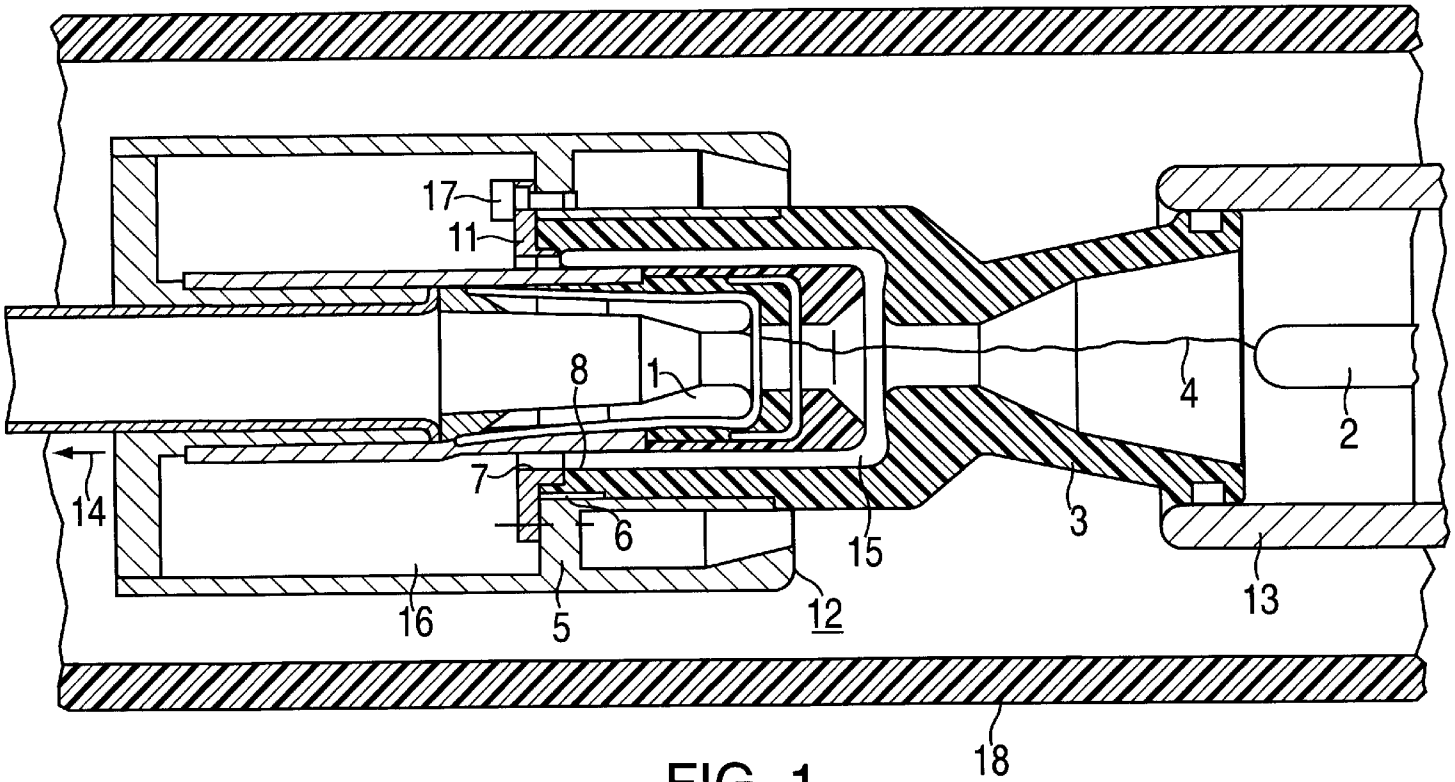
FIG. 1 schematically shows a longitudinal section of an interrupter unit.

The interrupter unit has two arcing contacts 1, 2, which coaxially oppose one another, and two continuous current contacts 12, 13, which concentrically surround the arcing contacts 1, 2, respectively. The first arcing contact 1 is designed as a tulip contact and is driven by a switch-off movement in the direction of arrow 14.

During the switch-off movement, an arc 4 is formed between arcing contacts 1, 2 and heats the extinguishing gas, e.g. $SF_6$, that is in its area of influence. This extinguishing gas flows, at least partially, through channel 15 into hot gas chamber 16, where it is stored initially and from where it flows back to the arc 4 as soon as the extinguishing gas pressure drops there. This is normally the case during a zero crossing of the current to be switched.

The extinguishing gas flowing back blows out arc 4 and supports extinguishing, i.e., reestablishing the dielectric strength of the gap between arcing contacts 1, 2.

In order to control the flow of the extinguishing gas flowing back to the arc regarding intensity and direction, an insulating gas nozzle 3 surrounding the arc is provided. Nozzle 3 made of insulating material with activatable first contact 1 is strongly accelerated in the direction of arrow 14 during the switch-off process.

For this reason and due to the high temperatures and gas pressures prevailing in the area of the nozzle made of insulating material, this nozzle must be secured in a particularly stable and reliable manner on a component connected with the switch drive, for example, with cylindrical flange 5.

Nozzle 3 made of insulating material is screwed into flange 5 and has, for this purpose, an external thread 20 engaging with the internal thread 6 of flange 5.

Connection piece 7 is inserted into the nozzle made of insulating material from the interrupter unit drive side and protects the nozzle made of insulating material against radial deformation from the inside. Connection piece 7 is connected to a flange 11, which radially covers the body of the nozzle and is connected with flange 5 with screws 17. This ensures that connection piece 7 cannot be twisted.

Connection piece 7 has, on its external lateral surface, a knurling 10, as shown in FIG. 2 which is pressed into body of the nozzle 3 and thus prevents body of the nozzle 3 from twisting in internal thread 6. Connection piece 7 and flange 11 are advantageously made of metal, for example, aluminum.

The interrupter unit is surrounded in a gas-tight manner by an enclosure 18 made of insulating material.

What is claimed is:

1. An interrupter unit of a high-voltage circuit breaker comprising:

a cylindrical component;

at least two arcing contacts;

a hollow cylindrical nozzle coupled to the cylindrical component for blowing out an arc that may form between the at least two arcing contacts, the nozzle being composed of an insulating material and including at least one of an internal thread and an external thread for coupling to the cylindrical component, the nozzle further including a lateral surface situated opposite the at least one of the internal thread and the external thread; and a connection piece connectable to the interrupter unit and supporting the nozzle on the lateral surface of the nozzle, a side of the connection piece having a knurling thereon for securing the nozzle against twisting.

2. The interrupter unit according to claim 1, further comprising a flange firmly coupled to the cylindrical component and further coupled to the connection piece.

* * * * *